US006578979B2

(12) United States Patent
Truttmann-Bättig

(10) Patent No.: US 6,578,979 B2
(45) Date of Patent: Jun. 17, 2003

(54) ILLUMINATION BODY FOR REFRIGERATION DEVICES

(75) Inventor: Elisabeth Truttmann-Bättig, Brunnen (CH)

(73) Assignee: Lisa Lux GmbH, Brunnen (CH)

( * ) Notice: Subject to any disclaimer, the term of this patent is extended or adjusted under 35 U.S.C. 154(b) by 0 days.

(21) Appl. No.: 09/956,337

(22) Filed: Sep. 18, 2001

(65) Prior Publication Data

US 2002/0051357 A1 May 2, 2002

(30) Foreign Application Priority Data

Sep. 26, 2000 (CH) ..... 1888/00

(51) Int. Cl.[7] ..... F21V 33/00

(52) U.S. Cl. ..... 362/92; 362/238; 362/240; 362/249

(58) Field of Search ..... 362/92, 236, 237, 362/238, 240, 249, 252, 253, 800

(56) References Cited

U.S. PATENT DOCUMENTS 6,431,728 B1 * 8/2002 Fredericks et al. ..... 362/249

* cited by examiner

*Primary Examiner*—Sandra O'Shea
*Assistant Examiner*—John Anthony Ward
(74) *Attorney, Agent, or Firm*—McCormick, Paulding & Huber LLP

(57) ABSTRACT

The illumination body (1) according to the invention consists of a U-shaped rod profile (16) which on the open side is provided with a transparent covering (20) and in which in a tight packing behind one another there are inserted several modules (3). The modules (3) consist of a plastic housing (4) with a base plate (5) on which carrier webs (6) are formed. The carrier webs (6) define rest surfaces which are inclined to one another and on which the circuitboard strips (7) lie. On the circuitboard strips (7) there are arranged a multitude of LEDs in series behind one another. The LEDs (2) have an angle of irradiation (β). Preferably the angle of irradiation (β) and the inclination (α) of two neighboring circuitboard strips to one another correspond to one another. Several modules (3) are behind one another fastened on a common rail (8) by way of screws (28) and thus preassembled may be inserted into the rod profile (16) which comprises suitable longitudinal webs (17) with longitudinal guide slots (18).

8 Claims, 2 Drawing Sheets

ILLUMINATION BODY FOR REFRIGERATION DEVICES

Figure 1:
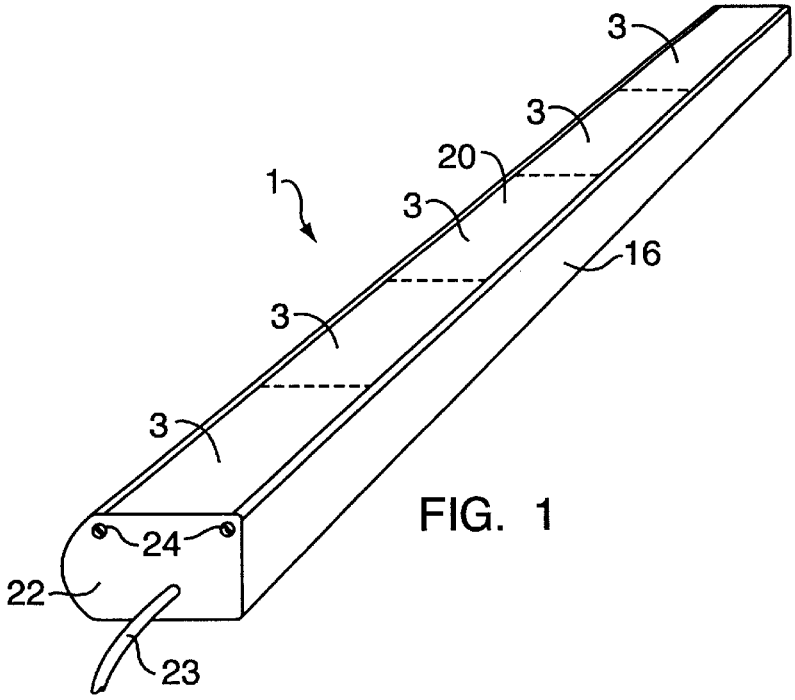

The present invention relates to an illumination body for refrigeration devices, with a multitude of light-emitting diodes (LED).

By way of commercially available lamps a broad wave spectrum in the visible and invisible range is produced. With this maximally 35% of the applied electrical energy is converted into visible light. In the invisible range when required the UV irradiation must be reduced by way of expensive filters. However there remains a high residual component of UV and IR irradiation which burdens living beings, foodstuffs and UV-sensitive objects on account of the high concentration. Also for the resulting high heat burdening suitable measures must be carried out in order to reduce their effect. In order to reduce the effect of this photochemically effective irradiation on foodstuffs one may either reduce the total illumination or select an illumination with a wavelength which creates a lower photochemical activity. Such an illumination may be produced by way of light emitting diodes (LEDs). By way of LEDs monochromatic light with a narrow wavelength band width may be produced. These known LEDs may produce accordingly low-UV light and furthermore have a low IR irradiation. In the field of refrigeration devices this leads to an extremely desired energy saving effect. Furthermore the LEDs have a sevice life which is five to ten times longer with respect to conventional lighting tubes.

The illumination according to DE-U-297 15 157 exploits these advantages. In this document it is suggested to arranged a multitude of LEDs in a position arranged tightly next to one another in a plane on a board. Since it was already known to the applicant that LEDs have an extremely narrow irradiation angle, he suggests arranging at a certain distance over the LEDs a ** diffusely letting through the light. An improved scattering of the light by way of this is only produced in a limited manner.

A further possibility of reducing the disadvantages of the narrow irradiation angle lies in mounting the suitable lighting bodies in a certain arrangement in the refrigeration device in order by way of this to achieve an optical effect of a full irradiation. Such a solution is known from DE-U-297 17 444.

In order according to the previous state of the art to illuminate refrigeration devices with lighting bodies which contain light-emitting diodes according to the state of the art of today one always practically has to provide a device suitably designed for this. It is the object of the present invention to provide an illumination body which may be used instead of todays common lighting tubes without at the same time effecting a reduction of the illumination.

It is further the object of the invention to construct the illumination body in a modular manner so that according to the selection of the number of modules practically all usual standard lengths of lighting tubes may be replaced without having to adapt too much.

This object is achieved by an illumination body for refrigeration devices with the features of the patent claim 1.

Further advantageous embodiment forms are to be deduced from the further claims and their effect and significance is indicated in the subsequent description.

Figure 2:
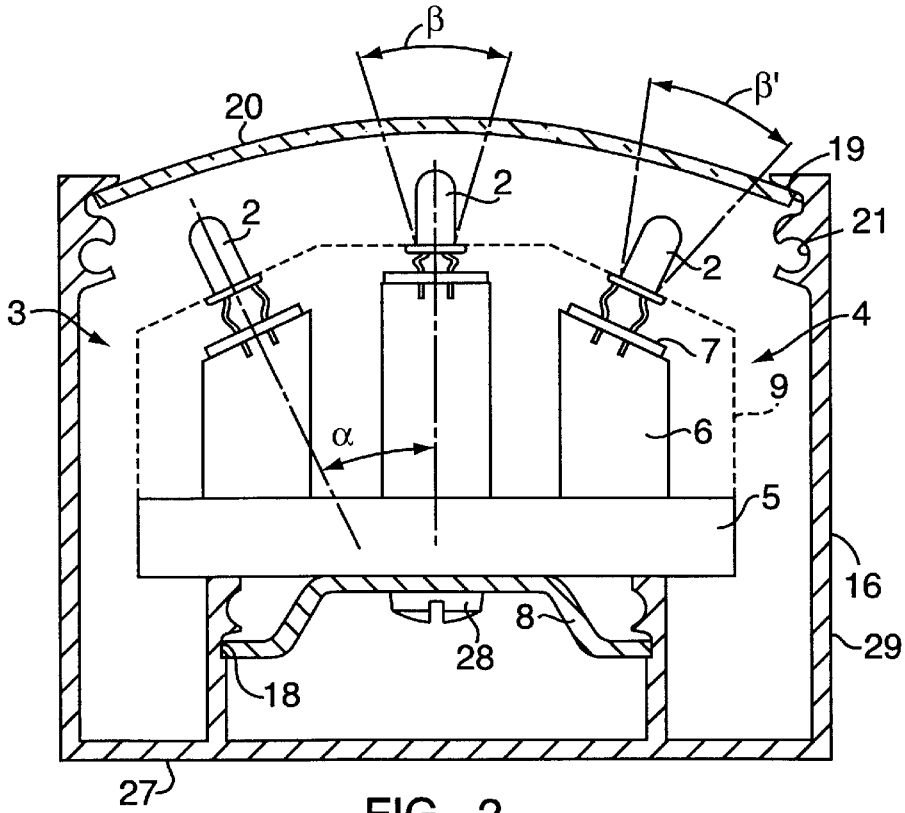
Figure 3:
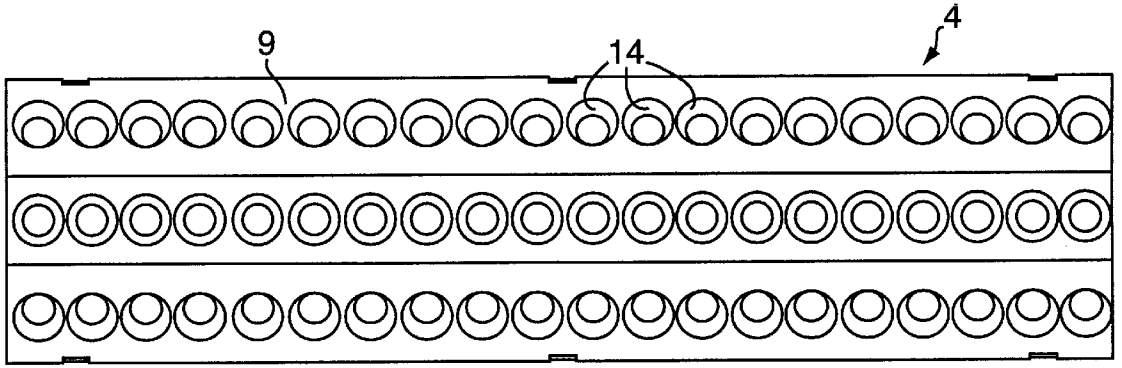
Figure 4:
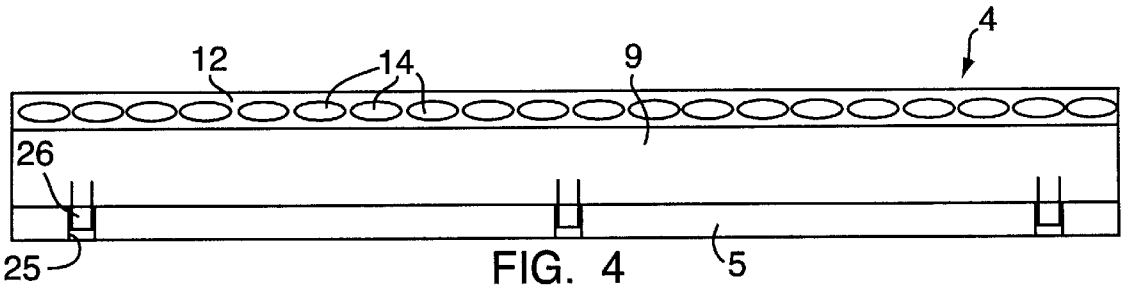
Figure 5:
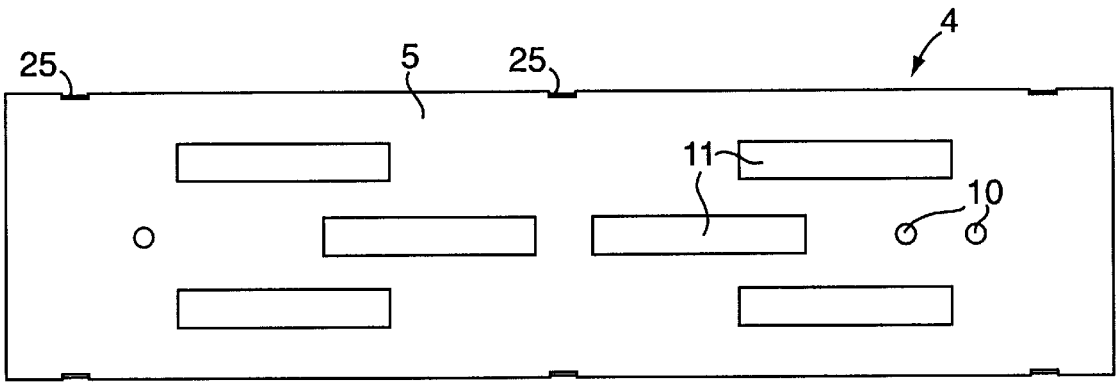
Figure 6:
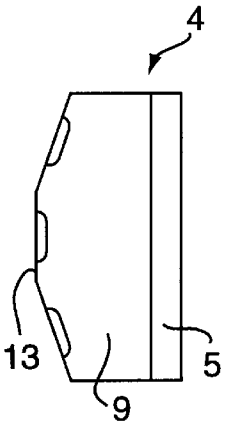

In the drawing there is shown a preferred embodiment form of the subject-matter of the invention and this is described hereinafter. There are shown in:

FIG. 1 a perspective total view of the illumination body according to the invention in the assembled condition;

FIG. 2 a vertical section through the illumination body with a cross-sectional shape which has been slightly modified with respect to FIG. 1, wherein a module contained therein can be seen;

FIG. 3 shows a plastic housing for forming a module in a view from above and FIG. 4 in a lateral view, whilst FIG. 5 shows the plastic housing with a view from below of the base plate and FIG. 6 the end-face of the assembled plastic housing according to the FIGS. 3 to 5.

The assembled illumination body 1 according to the invention as it is perspectively shown in FIG. 1 does not look very different from a conventional illumination body in which for example a lighting tube may be accommodated. In the view according to FIG. 1 one recognises from the outside only a U-shaped rod profile 16 which is laterally closed by a lateral covering 22 through which the feed cable is led to the outside. The lateral covering 22 is fastened by fastening screws 24 on the U-shaped rod profile 16. The open side of the U-shaped rod profile 16 is terminated with a transparent covering 20. The transparent covering 20 is selected from a material which leads to a bending of the light which increases the irradiation angle of the light diodes LED and simultaneously leads to a more diffuse light. In the U-shaped rod profile 16 which in its length may be adapted to the requirement in a refrigeration device, there are accommodated the number of modules 3 according to the requirement.

FIG. 2 shows in principle a section transversely to the longitudinal direction of the illumination body 1, wherein however the U-shaped rod profile 16 has a somewhat modified cross-sectional shape with respect to the version according to FIG. 1. The version according to FIG. 1 has an curved side surface and thus results in an illumination body which in particular also on the edge may be accommodated at a place of deposit in a refrigeration device. In the U-shaped rod profile 16 shown according to FIG. 2 as already mentioned the two free limbs are directed upwards in a parallel and planar manner. On the plane base surface 27 of the rod profile 16 in the inner surface there are integrally formed on as one piece two parallel longitudinal webs of equal height directed upwards. On the two flanks of the longitudinal webs which are directed to one another there are present longitudinal guide slots 18 which serve the insertion of a rail 8. The module is rigidly screwed onto this rail 8 by way of screws 28. The side walls 29 of the U-shaped profile 16 have in the upper region on the one hand grooves 19 extending in the longitudinal direction and on the other hand bores 21 which extend over the whole profile length and which are open approximately to a quarter extent. Into the grooves 19 the already mentioned transparent cover may be laterally inserted. The open bores serve for fastening the lateral coverings 22 by way of fastening screws 24. With this the fastening screws 24 penetrate into the open bores 21. For this one preferably uses screws which cut their threads into the bores 21 themselves.

The illumination body 1 as mentioned consists of the U-shaped rod profile 16 in which several modules 3 are inserted. These modules 3 consist of a plastic housing 4 in which the light-emitting diodes 2 are accommodated. This plastic housing 4 is shown detailed in the FIGS. 3–6. The plastic housing 4 is a box-like receptacle with a base plate 5 and a lid 9 which may be placed thereon. The lid 9 has vertical lateral walls and is covered with a curved cover surface 13. In the curved cover surface 13 there is present a pattern of holes 14, wherein all holes are surrounded by a deepened part in order to have as low as possible light loss.

In the shown example the curved cover surface 13 is formed of three elongate part surfaces. In each of these strip-like part surfaces there is arranged a row of passage holes for leading through the light-emitting diodes. The lid 9 may be placed onto the base plate 5 in the manner of being snapped on. Accordingly in the side walls of the base plate 5 there are provided latching-in niches 25 into which engage the latch-in tongues 26 which are moulded on the side wall of the lid 9. In the base surface of the base plate 5 are attached various holes. On the one hand there are present various round holes 10 lying on the middle axis which serve the fastening of the base plate and thus indirectly the whole module 3 on the rail 8. Furthermore there are provided various elongate holes 11 which serve the cable lead-through. The cable connections which here are not shown serve the supply of the modules which are arranged behind one another. The modules 3 may be connected in series as well as in parallel.

On the base surface of the base plate 5 which in FIG. 2 is shown in the covered condition one recognises that on the inner side of the base plate 5 there are arranged several carrier webs 6 which stand vertically upwards. The number of the carrier webs 6 is directed according to the number of the circuitboard strips 7 to be accommodated in the module. In the shown preferred example there are present three such circuitboard strips 7. They run over the whole length of the base plate 5 on several carrier webs 6 which are suitably arranged at distances behind one another. In the normal case three such carrier webs are sufficient for a circuitboard strip 7. The carrier webs 6 end at their upper ends in a plane which in each case is the plane in which a circuitboard strip 7 runs. As is clearly recognisable from the Figure in each case two neighbouring circuitboard strips 7 are attached in two planes which enclose an angle $\alpha$ to one another. This angle should correspond roughly to the size of the irradiation angle of the light diodes. The irradiation angle of the light diode is here indicated at $\beta$. By way of the bending of the light on passing through the transparent covering 20 the irradiation angle $\beta$ is accordingly enlarged so that now the irradiation angle corresponds to $\beta'$.

LEDs have a relatively narrow irradiation angle. LEDs available on the market have an irradiation angle of maximally 22°. For a decent large-surfaces illumination today one compensates by equipping a large as possible surface with LEDs. In order to achieve a sufficient lighting density correspondingly an enormous number of LEDs were required. The present invention not only shows an arrangment which leads to an improved illumination and to a reduction in the number of LEDs but also the whole design is furthermore extremely easy to manufacture, permits an ideal modular manner of construction and leads additionally to a secure mounting of the LEDs. Also the assembly, of the individual modules as well as also the modules into an illumination body is extremely simple.

Apart from the preferred embodiment form shown here of course various variations are possible. Thus in particular also the whole module may be wider and accordingly also the illumination body 1. For this one would widen the individual carrier webs 6 so that on each circuitboard strip in each case transversely to the longitudinal direction there is place for two LEDs next to one another. Also the selection of the LEDs may of course be effected according to requirement. More preferred one would apply the white light diodes obtainable today and mix these with suitable colour diodes according to requirement. Thus one may use white light diodes with yellow light diodes in regions where one presents fresh bakery products or white light diodes may be mixed with red light diodes when the illumination body is to be used in the fresh meat region.

The illumination body 1 is usually supplied with low voltage direct current. Rectifiers and transformers may in principle be integrated in the illumination body 1. Since these however produce a certain amount of waste heat one would preferably arrange these components outside the illumination body.

What is claimed is:

1. An illumination body for refrigeration devices, with a multitude of light-emitting diodes LEDs, characterised in that the illumination is built up of module-forming plastic housings, wherein each plastic housing comprises a base plate with carrier webs on which lie circuitboard strips, wherein the circuitboard strips have the length of a plastic housing, and that in every housing there are arranged several circuitboard strips which in the longitudinal direction run parallel but inclined to one another, wherein the angle of inclination to one another at least approximately corresponds to the irradiation angle of the light emitting diodes, and wherein the illumination body has a rod profile which is essentially U-shaped in cross section, and that all module-forming plastic housings are held on a rail which is insertable into longitudinal guide slots.

2. An illumination body according to claim 1, further including two parallel longitudinal webs, and wherein the longitudinal guide slots are defined by the longitudinal webs.

3. An illumination body according to claim 1, characterised in that the module-forming plastic housing comprises a lid which may be placed onto the base plate and which is provided with an upper cover surface which is curved such that it forms the enveloping surface defined by the circuitboard strips, and is provided with a hole pattern through which the LEDs project and with this are held therein.

4. An illumination body according to claim 1, characterised in that in each plastic housing there are arranged three circuitboard strips.

5. An illumination body according to claim 1, characterised in that on each circuitboard strip there is present a row of LEDs arranged tightly behind one another.

6. An illumination body according to claim 1, characterised in that the base plate comprises round holes for fastening the plastic housing on a carrier rail and elongate holes for leading through electrical leads.

7. An illumination body according to claim 1, characterised in that the LEDs of each module are supplied in series and the modules amongst one another are supplied in parallel.

8. An illumination body according to claim 1, characterised in that in the ends of the free flanks of the U-shaped rod profile there are present grooves into which a transparent plastic covering is inserted.

* * * * *